United States Patent [19]

Pasternack

[11] 4,405,348

[45] Sep. 20, 1983

[54] COOLING DEVICE PARTICULARLY FOR HEAT PROTECTIVE SUITS

[75] Inventor: Adalbert Pasternack, Bad Schwartau, Fed. Rep. of Germany

[73] Assignee: Drägerwerk AG, Fed. Rep. of Germany

[21] Appl. No.: 297,179

[22] Filed: Aug. 28, 1981

[30] Foreign Application Priority Data

Nov. 29, 1980 [DE] Fed. Rep. of Germany ..... 3045110

[51] Int. Cl.[3] ..... F25D 23/12

[52] U.S. Cl. ..... 62/259.3; 62/372; 62/384; 62/388

[58] Field of Search ..... 62/259.1, 259.3, 384, 62/386, 398, 399, 400, 459, 464, 371, 372, 529, 530, 457, 385, 387, 388

[56] References Cited

U.S. PATENT DOCUMENTS

| | | | |
|---|---|---|---|
| 1,782,720 | 11/1930 | Franklin | 62/372 X |
| 1,941,173 | 12/1933 | Horvitz | 62/384 X |
| 2,255,356 | 9/1941 | Harris et al. | 62/398 X |
| 2,713,779 | 7/1955 | Fitzgibbons | 62/386 X |
| 3,315,491 | 4/1967 | Zant | 62/398 X |
| 4,294,079 | 10/1981 | Benson | 62/388 X |

*Primary Examiner*—Lloyd L. King
*Attorney, Agent, or Firm*—McGlew and Tuttle

[57] ABSTRACT

A cooling device, particularly for heat protective suits, comprises, a housing having a bottom with a heat exchanger surface exposed therein, and a solid refrigerant, such as dry ice, overlying the heat exchanger surface. The ice is preferably biased toward the heat exchanger surface and a flexible intermediate layer is disposed between the dry ice and the heat exchanger surface. The flexible intermediate layer is saturated with a fluid, such as one which remains liquid to below the sublimation point of the solid refrigerant. The heat exchanger surface is advantageously connected through connecting lines and a pump to circulate it through various passages in the protective vest or suit.

4 Claims, 2 Drawing Figures

COOLING DEVICE PARTICULARLY FOR HEAT PROTECTIVE SUITS

FIELD AND BACKGROUND OF THE INVENTION

This invention relates to refrigerating devices in general and, in particular, to a new and useful cooling device particularly for heat protective suits which includes a solid refrigerant disposed in heat exchange relationship with a heat exchange surface with a flexible intermediate layer between the solid refrigerant and the surface which is saturated with an intermediate liquid.

Heat protection systems such as used in personal heat protection suits, comprise a solid refrigerant, such as $CO_2$ ice and a liquid, intermediate cooling agent. The latter is conducted through tubular flow channels incorporated in the suit near the body. It is by means of this intermediate cooling agent that a thermal equilibrium is maintained in which the body temperature cannot change beyond the physiologic limits.

The heat transfer between the solid refrigerant and the fluid intermediate cooling agent is very decisive for the safe functioning of such a system. This transfer can take place in a heat exchanger only at a separating point. The heat exchanger must also adapt to the basic requirement of low weight and volume since the suit is worn by the equipment carrier.

One known cooling vest, used as equipment to be worn individually, contains a circulating liquid cooling agent, such as a silicon oil, in cavities on its inside facing the body. The circulation is formed by cooling vest cavities in conjunction with external system components including a booster pump and a heat exchanger. The heat exchanger contains as the refrigerant, a $CO_2$ dry ice filling in granulated form which, under sublimation, removes heat absorbed by the cooling vest from the circulating intermediate cooling agent. The $CO_2$ gas formed thereby is utilized to operate the booster pump.

A contact pressure element ensures good heat transfer at the heat exchanger surfaces, and also in operation independent of position. The contact pressure element, which is moved by a compression spring, pushes the $CO_2$ dry ice against the heat exchanger surfaces for reliable heat transfer and, at the same time, prevents the formation of a $CO_2$ gas cushion which impedes the heat transfer. However, it is disadvantageous that, in the granule layer in contact with the heat exchanger surfaces, the interstices between the grains diminish the heat transfer due to the layer's grainy structure. This necessitates larger heat exchanger surfaces which thus become heavier and bulkier than would be necessary if the heat transfer were optimal (Drägerhaft 310, Jan./Apr. 1978, pages 17–24).

SUMMARY OF THE INVENTION

The present invention provides a heat exchanger in a refrigerating device for heat protection systems in heat protection suits wherein the heat transfer is maximized at the separating point between the solid refrigerant and the intermediate cooling agent independent of position, thereby making it possible to build it with the least weight and volume.

In accordance with the invention, the solid refrigerant which is positioned in the housing overlying a heat exchange surface is separated from the surface by a flexible intermediate layer which is saturated with an intermediate liquid.

To obtain good heat transfer, the better thermal conductivity of a fluid in relation to air and the good adaptability of the intermediate layer to the individual granules of the solid refrigerant and to the heat exchanger tubes are utilized. The size of the direct heat transfer surface is maximized. The fluid in the material of the intermediate layer assures good heat transfer and transmission. In any case, the thermal conductivity of the fluid is significantly greater than that of air which would otherwise be value-determining at the transfer point. The absorption of the fluid in the porous material makes the heat exchanger independent of position. Efficiently operating small and light heat exchangers can be built with the intermediate layer according to the invention.

Accordingly, it is an object of the present invention to provide a cooling device, particularly for heat protective suits, which comprises a housing, a heat exchange surface disposed in the housing with a solid refrigerant overlying the heat exchange surface and an intermediate layer of flexible material between the refrigerant and the surface and including a liquid intermediate cooling agent saturating the intermediate layer.

A further object of the invention is to provide a cooling device, particularly for heat protective suits, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENTS

Figure 1:
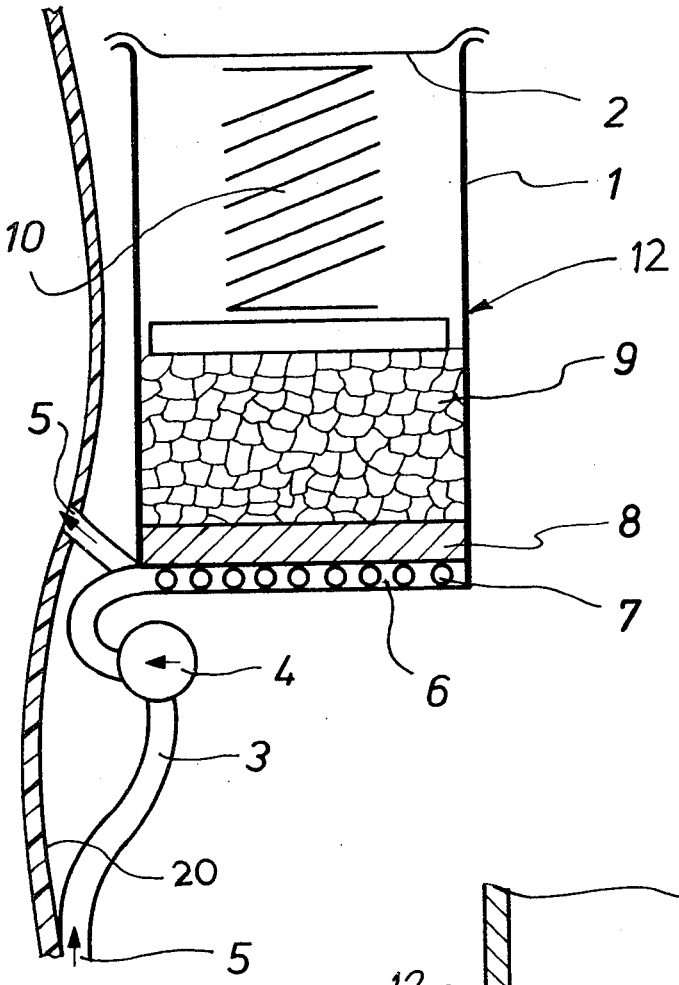
FIG. 1 is a schematic sectional view of a cooling device, particularly for heat protective suits, constructed in accordance with the present invention.

Referring to the drawings in particular, the invention embodied therein, comprises a cooling device, particularly for heat protective suits, generally designated 10, which comprises a housing, generally designated 12, having a heat exchanger surface 6 exposed in the housing with a solid refrigerant 9 overlying the heat exchanger surface and including an intermediate layer 8 of flexible material between the solid refrigerant and the heat exchanger surface.

To facilitate heat transfer, a fluid which remains liquid to below the sublimation point of the solid refrigerant is filled into the space occupied by the flexible intermediate layer 8 to substantially saturate it.

The heat exchanger elements are contained in a housing comprising a bottom part 1 and a cover 2. A fluid, preferably a liquid, intermediate cooling agent 5 is supplied to the bottom part 1 through a line 3 and is moved by a booster pump 4. In bottom part 1, the cooling agent 5 is conducted through a heat exchanger surface 6 made up of individual tubes 7. Above an intermediate layer 8, in contact with the tubes 7, the bottom part 1 contains $CO_2$ dry ice as a solid refrigerant 9. A contact pressure generator 10 assures firm and position-independent packing of the solid refrigerant 9.

Figure 2:
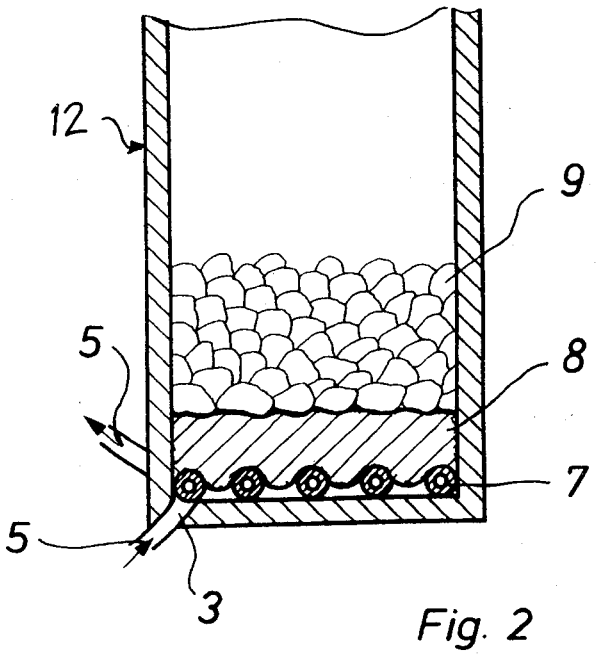
FIG. 2 is a view similar to FIG. 1 showing the intermediate layer in more detail.

FIG. 2 demonstrates the function of the intermediate layer 8. It consists of an open-pored foam material. Compressed by the contact pressure generator 10, it makes intimate contact with both the tubes 7 and the individual granules of the solid refrigerant 9, covering the underside of the solid refrigerant 9. The heat transfer surface is thus utilized to the maximum. The heat transfer and heat transmission between the solid refrigerant 9 and the tubes 7 through the intermediate layer 8 takes place via a fluid such as silicon oil or dimethyl alcohol with which the open-pored foam material is filled to the saturation limit. A fluid is selected which remains highly fluid to below the sublimation point of the solid refrigerant 9.

While a specific embodiment of the invention has been shown and described in detail to illustrate the application of the principles of the invention, it will be understood that the invention may be embodied otherwise without departing from such principles.

What is claimed is:

1. A method of cooling a heat protective device, such as a vest, using a solid refrigerant disposed over a heat exchange surface, comprising, circulating an intermediate liquid cooling agent over said surface and through the garment, and in order to increase the heat transfer of the solid refrigerant, disposing a flexible intermediate layer between the solid refrigerant and the surface and saturating the layer with a fluid which remains liquid below the sublimation point of the solid refrigerant.

2. A method, as claimed in claim 1, wherein the solid refrigerant is dry ice.

3. A cooling device for heat protective garments, comprising a housing, a heat exchange surface exposed in said housing, a solid refrigerant overlying said heat exchange surface, an intermediate layer of flexible material between said solid refrigerant and said heat exchanger surface, a fluid which remains liquid to below the sublimation point of said solid refrigerant saturating said intermediate layer of material, and means for circulating a garment cooling fluid in heat exchange relationship with said heat exchanger surface.

4. A cooling device, particularly for heat protection suits, comprising, a housing, a heat exchanger surface exposed in said housing, a solid refrigerant overlying said heat exchanger surface, an intermediate layer of flexible material between said solid refrigerant and said heat exchanger surface, and a fluid which remains liquid to below the sublimation point of the solid refrigerant saturating said intermediate layer of flexible material, and means for urging the solid refrigerant into contact with said heat exchanger surface, said flexible intermediate layer comprising an open pored synthetic foam material filled to saturation with said fluid.

* * * * *